US005605241A

United States Patent [19]

Imperioli

[11] Patent Number: 5,605,241

[45] Date of Patent: Feb. 25, 1997

[54] HYDRAULICALLY CONTROLLED CONTAINER DISCHARGE LID TO PREVENT SPILLAGE

[76] Inventor: Rosemarie V. Imperioli, 901 Earl of Chatham La., Virginia Beach, Va. 23454

[21] Appl. No.: 373,939

[22] Filed: Jan. 13, 1995

[51] Int. Cl.[6] ..... B65D 55/16

[52] U.S. Cl. ..... 215/306; 215/354; 215/355; 220/281; 220/375; 220/789; 222/213; 222/554; 222/563

[58] Field of Search ..... 215/228, 306, 215/355, 354, 209, 211; 220/281, 283, 307, 375, 89.1, 203.13; 222/554, 563, 206, 212, 213

[56] References Cited

U.S. PATENT DOCUMENTS

| | | | |
|---|---|---|---|
| 2,946,606 | 7/1960 | Smith | 215/364 |
| 3,443,712 | 5/1969 | Hauser | 215/209 |
| 4,060,100 | 11/1977 | Miller et al. | 138/89 |
| 4,322,012 | 3/1982 | Conti . | |
| 4,420,092 | 12/1983 | Finkelstein | 220/254 |
| 4,770,305 | 9/1988 | Su . | |
| 4,789,082 | 12/1988 | Sampson . | |
| 4,842,152 | 6/1989 | Donegan . | |
| 4,858,776 | 8/1989 | Mehra . | |
| 4,938,390 | 7/1990 | Markva . | |
| 4,942,966 | 7/1990 | Kemp . | |
| 4,949,857 | 8/1990 | Russell . | |
| 4,953,706 | 9/1990 | Piccard . | |
| 5,044,531 | 9/1991 | Rhodes, Jr. . | |
| 5,150,528 | 9/1992 | Shire | 220/375 X |
| 5,301,845 | 4/1994 | Labonte | 222/211 |
| 5,456,294 | 10/1995 | Tsao et al. | 141/1 |

FOREIGN PATENT DOCUMENTS

| | | | |
|---|---|---|---|
| 49215 | 5/1974 | Australia | 215/209 |
| 1378912 | 12/1964 | France | 215/306 |

*Primary Examiner*—Stephen Cronin
*Attorney, Agent, or Firm*—Robert E. Bushnell, Esq.

[57] ABSTRACT

A device for controllably retaining a liquid to prevent spillage when the bottle is tilted or inverted for positioning the bottle to discharge the container's liquid contents into the intended orifice. The hydraulically operated plug forms an air tight seal with the smooth inner surface of the neck of the container, permitting the container to be inverted and positioned over the intended receptacle without releasing any fluid. Upon squeezing the flexible container, the lid is forced from the container by the hydraulic pressure exerted on the inner surface of the lid, permitting the liquid to pour freely from the container into the intended receptacle. A tether attaching the plug to an exterior location on the container allows the plug to fall clear of the stream of flow while preventing the plug from becoming lost.

15 Claims, 5 Drawing Sheets

HYDRAULICALLY CONTROLLED CONTAINER DISCHARGE LID TO PREVENT SPILLAGE

FIELD OF THE INVENTION

The present invention relates to controlling the discharge of a fluid from an inverted flexible container until pressure is exerted on the container to force a lid from an opening in the container. More particularly, the present invention relates to dispensing oil from a flexible plastic oil bottle into the intended oil opening of an internal combustion engine.

BACKGROUND OF THE INVENTION

The problem of pouring liquids from a container into a receptacle in a relatively inaccessible location without spilling any of the liquid is well known. As a general rule, the container must be either tilted or turned upside town in order to discharge its contents. Frequently, the problem occurs when attempting to pour motor oil or transmission fluid into valve covers or fill spouts having narrow openings which may be partially obscured by other engine components or be separated as by ignition wires and coolant hoses from the closest approach of the container.

Currently, several devices (typically funnels) are available for screwing onto the neck of an oil container to attempt to control the flow and direction of the oil. These devices suffer from the disadvantage of their size, which prohibits them from being bundled with the oil containers when packaged. They also do not lend themselves to manufacture by companies when the oil container is being produced; they are also capable of soiling objects with which they may come into contact after their use, and need to be stored in an air tight bag to prevent the device from soiling objects with which they may come into contact.

Other devices control oil discharge by permanently affixing a secondary seal formed from a thin foil over the mouth of the container. These devices prevent leakage or accidental spillage of the contents, but are unable to selectively release the oil while the container is inverted and aligned with an opening in the intended receptacle.

Various attempts have been made to overcome the foregoing disadvantages. U.S. Pat. No. 4,953,706 to Piccard discloses a Mechanical Oil Seal Breaker comprising a seal perforation blade loaded internally of the container, to puncture the secondary seal affixed to the container mouth when the container is squeezed. U.S. Pat. No. 5,044,531 to Rhodes, Jr. discloses a frangible air tight seal that is purported to rupture in some fashion when the bottle is squeezed, due to the increased internal pressure. Similarly, U.S. Pat. No. 4,789,082 to Sampson, U.S. Pat. No. 4,938,390 to Markva, and U.S. Pat. No. 4,949,857 to Russell each disclose essentially flat secondary seals that are asserted to either rupture or release the adhesive bond holding the seal to the container mouth in response to pressure applied by squeezing the container. Since the above described secondary seals are permanently loosened or ruptured in order to discharge the oil, they can not be resealed when only a portion of the oil in the container is used. Moreover, the force required to stretch and then rupture the seal tends to too quickly discharge the contents of the container. If the foil seal is ruptured and pushed into the container or the foil seal is ruptured upon squeezing the container pieces of the foil could flow with the oil into the intended receptacle and possibly cause damage to an engine by blocking the engine oil raceway or oil mains.

The Spill Proof Plug disclosed in U.S. Pat. No. 4,842,152 is a reusable plug inserted in the mouth of a container which can be forced from the mouth when the container is inverted and squeezed. The containment wall portion of the plug inserted into the container mouth however, is of uniform diameter and must be made slightly larger than the container mouth to insure an air tight fit while at the same time not being so tight as to prevent the plug from being forced from the opening when pressure is applied. Furthermore, the internal stem that prevents the plug from being separated from the container also holds the plug directly in front of the container mouth, thereby disrupting the smooth pouring of oil into a receptacle in those situations where the neck of the container will not fit within the receptacle opening or the opening is partially obstructed.

Accordingly, I have discovered that a need exists for a discharge control device which does not have the aforementioned limitations and disadvantages.

SUMMARY OF THE INVENTION

It is an object of the present invention to provide an improved container seal.

It is a further object to provide a lid for a container, which can be used as a reusable lid for a container, replacing the broken foil seal.

It is a further object to provide a lid for a container which can be easily expelled from the opening while the container is inverted.

It is a still further object to provide a reusable lid for a container which can be tethered to the container without interfering with fluid flow after the lid is removed from the container opening.

These and other objects can be achieved with a hydraulically expellable lid adapted to form an air tight seal with a smooth inner surface of the neck of a flexible container. The lid is formed as a beveled plug having a ridge circumscribing a central portion, for releasably engaging the smooth inner surface of the neck, and an upper lip extending radially outward from the plug for preventing the plug from being forced too deeply into the mouth of the container. A tether attaches the external portion of the lid to a point on the exterior of the container to prevent the lid from falling into the opening of a receptacle into which the liquid is to be poured.

In one embodiment the tether and hydraulic lid may be formed as part of the neck of the container. In another embodiment, the tether and hydraulic lid may be formed as part of a thread cap for the container. One end of the tether terminates in a tamper resistant ring portion of the cap, which remains around the neck of the container when the cap is removed. In yet a third embodiment, the tether and hydraulic lid may be constructed as a discrete component. The free end of the tether is formed into an elastic loop which is stretched around the neck of the container.

BRIEF DESCRIPTION OF THE DRAWINGS

A more complete appreciation of this invention, and many of the attendant advantages thereof, will be readily apparent as the same becomes better understood by reference to the following detailed description when considered in connection with the accompanying drawings in which like reference symbols indicate like components, wherein.

DETAILED DESCRIPTION

Figure 1:
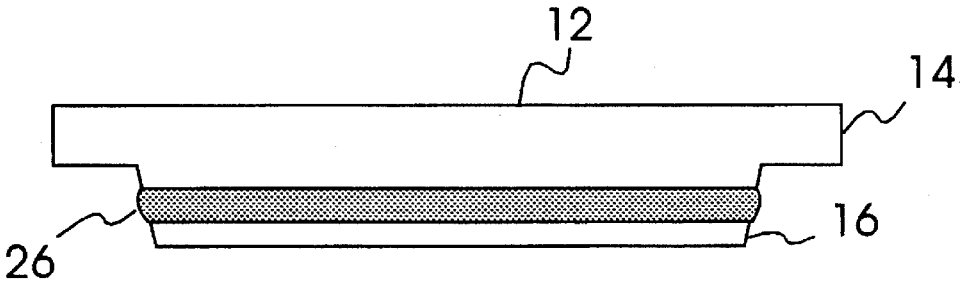
FIG. 1 is an enlarged cross-sectional view of a lid constructed according to the principles of the present invention.

Turning now to the drawings, and first to FIG. 1, a hydraulic lid 12 is formed as a single piece having an internal portion 16 extending into the mouth of a container when the lid is in place, and a larger diameter external portion 14 extending outwardly from the internal portion 16. A seal 26 forms a raised circumferential ridge having rounded edges circumscribing the internal portion 16 of the hydraulic lid 12. The ridge seal 26 is slightly larger than the internal circumference of the container mouth, so that when the lid 12 is pressed onto the container the ridge seal 26 is compressed and forms an air tight seal. The ridge seal 26 may be constructed from a separate material, such as a rubber or Neoprene O-ring placed in a slot formed into the internal portion 16, but is preferably cut into a mold for the hydraulic lid and integrally formed from the same material as the lid.

Figure 2A:
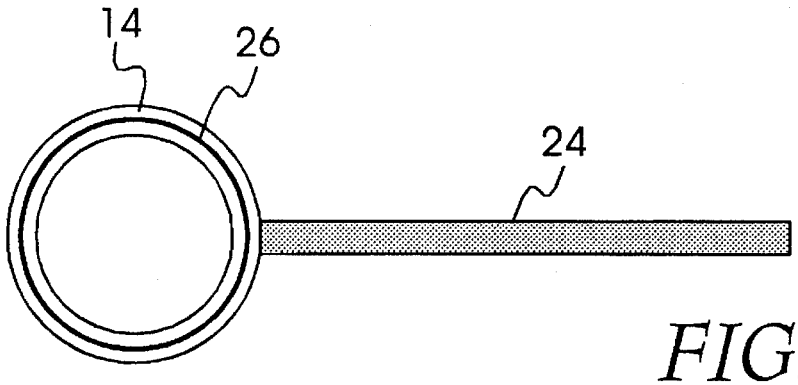
FIGS. 2A, 2B, and 2C illustrate a bottom, side, and top view of a lid and tether constructed according to one embodiment of the present invention.
Figure 2B:
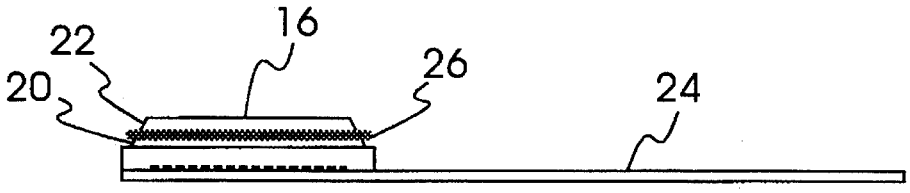

As shown in FIG. 2B, the internal portion 16 tapers from a first diameter 20, which is approximately the same size as the internal diameter of the container mouth, to a second diameter 22 smaller than the first diameter. The ridge seal 26 extends outwardly beyond the upper diameter 20, and is intended to be the only part of the hydraulic lid 12 which contacts the smooth inner surface of neck of the container at the container mouth. By limiting the surface area actually contacting the inner surface of the neck to a relatively thin line, it is contemplated that the concentration of the compressive force along that line will improve the air tight seal without increasing the overall force necessary to dislodge the lid.

FIG. 2A illustrates that the external portion 14 of hydraulic lid 12 extends radially outward beyond upper diameter 20 (not shown) and ridge seal 26 of the internal portion. The external portion 14 forms a lip which covers the rim of the container mouth when the hydraulic lid is in place and prevents the hydraulic lid from being accidentally forced too deeply into the neck.

In the embodiment shown in FIG. 2A, the internal portion 16 of hydraulic lid 12 has a circular cross-section to match a circular internal cross-section of a container neck. Internal portion 16' however may also be formed having an irregular cross-section, as shown in FIG. 2D in which two sides of the circular cross-section of ridge seal 26' and smaller dimensional cross-section 22' are flattened, so long as the shape substantially conforms to the interior shape found in the neck of the container used. The external surface of at least the mouth portion of the container neck is generally circular to accommodate a threaded cap.

Figure 2C:
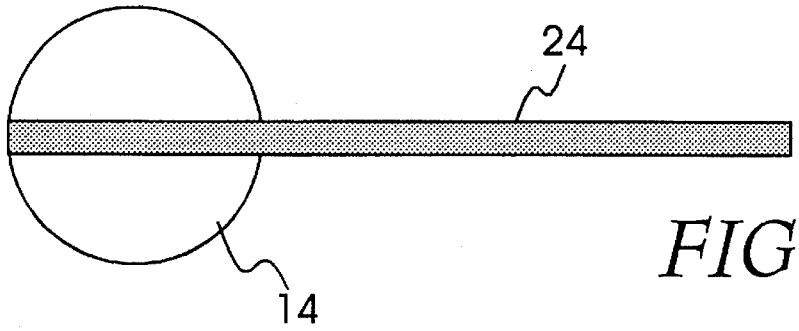
Figure 2D:
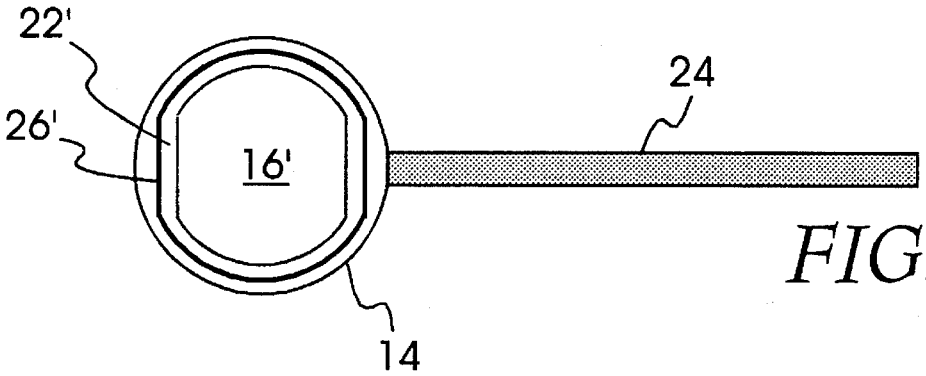
FIG. 2D illustrates a bottom view of the lid and tether according to another embodiment of the present invention.

A substantially flat ribbon forms a tether 24 shown in FIG. 2C, that may be either permanently attached at one end to the top of external portion 14, or formed as homogeneous extension of the hydraulic lid when the lid is formed. The opposite end of tether 24 is affixed to a point on the exterior of the container to prevent the hydraulic lid from becoming separated from the container and falling into the intended receptacle as the liquid is poured. Currently, three methods of attaching the tether to the exterior are contemplated.

Figure 3:
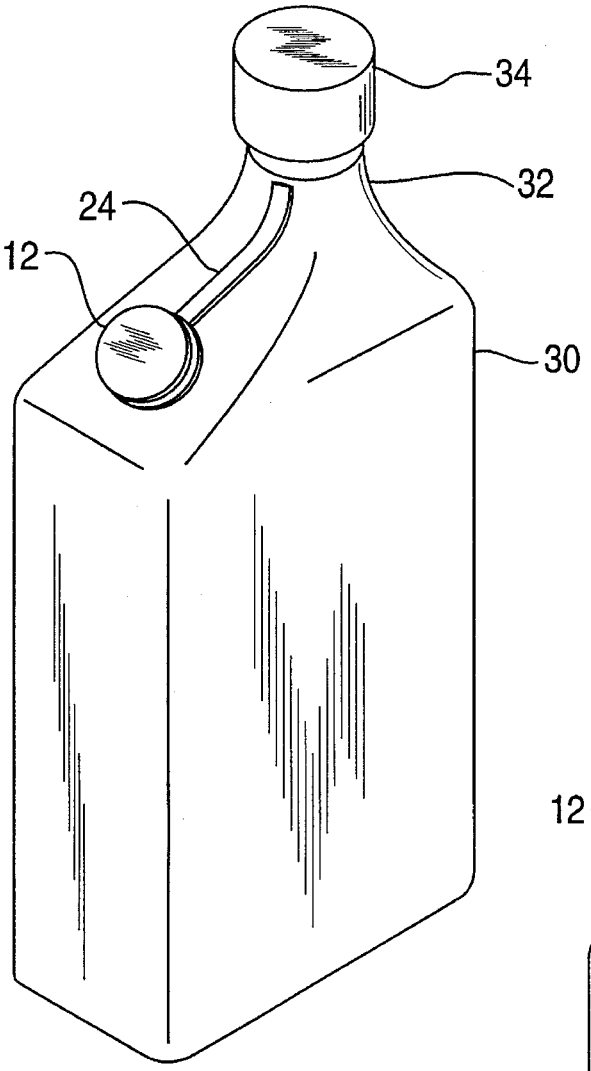
FIG. 3 illustrates an embodiment in which the hydraulic lid and its tether are formed as a part of the container.

In a first embodiment, illustrated in FIG. 3, the hydraulic lid 12 and its tether 24 can be integrally formed as part of the container 30 itself, with the tether extending from the neck 32 of the container.

Figure 4:
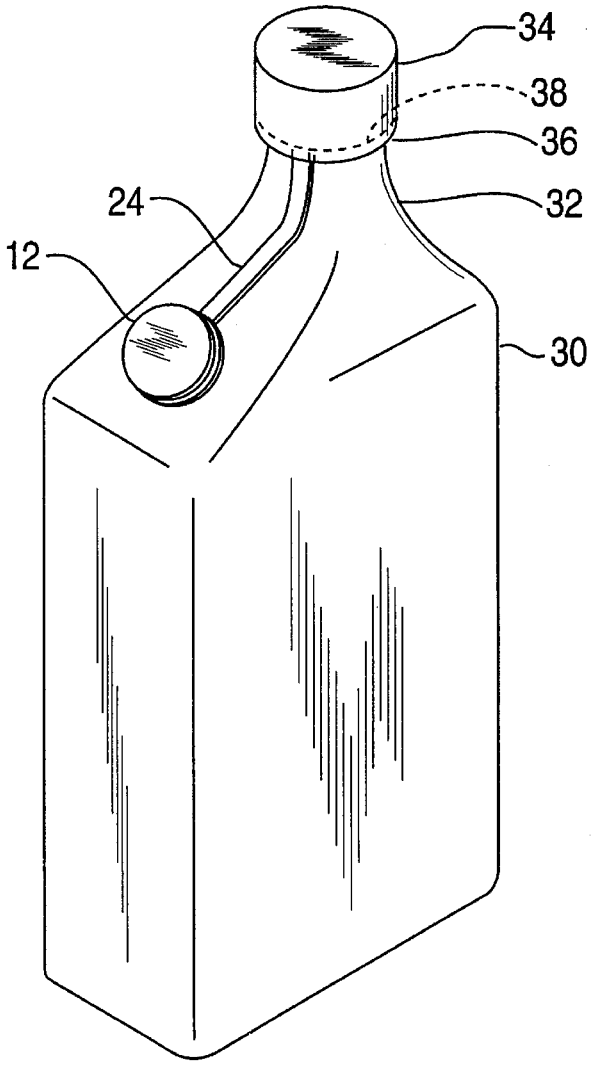
FIG. 4 illustrates an embodiment in which the hydraulic lid and its tether are formed as part of the container cap and perforated tamper-resistant ring.

In a second embodiment, illustrated in FIG. 4, the hydraulic lid 12 and its tether 24 can be formed as part of a cap 34 which screws onto a threaded exterior surface of neck 32 of container 30. The tether 24 is formed to a tamper resistant ring 36 separated from the threaded portion of the cap 34 by perforations 38. When the cap is unscrewed from the container, the cap separates along the perforations 38, leaving the tamper resistant ring 36 behind, held to the neck of the container by conventional means. Accordingly, the hydraulic lid 12 is also prevented from becoming separated from container.

Figure 5:
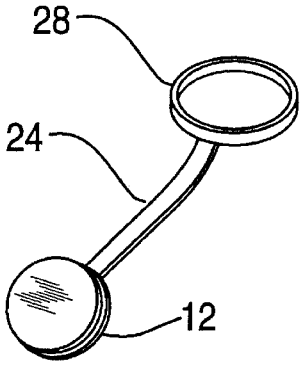
FIG. 5 illustrates an embodiment in which the tether has an elastic loop formed at one end for encircling the neck of the container.

In each of the above described first and second embodiments, the manufacturer need not insert the lid into the container opening because the lid is formed attached to an existing component, thereby eliminating the need to add an additional assembly operation for the present invention. In a third embodiment however, illustrated in FIG. 5, the hydraulic lid 12 and its tether 24 can be formed as a detached component and supplied separately. Tether 24 is manufactured with an elastic loop 28 formed onto the free end. The loop has a lesser length than the external circumference of the neck of the container, so that it may be stretched around the neck by either the manufacturer or the user and elastically retained in place when the container is inverted. It can also be the same size and material as the container perforated tamper-resistant ring and be placed upon the container neck with the tamper-resistant ring or it can replace the tamper-resistant ring.

Figure 7:
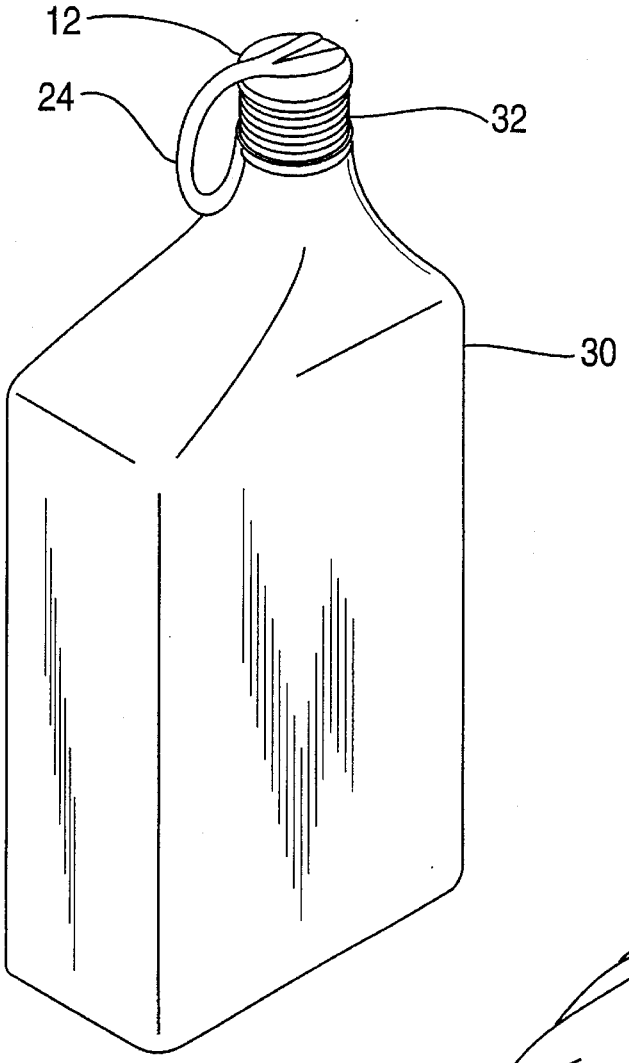
FIG. 7 illustrates a container with the lid and tether in place according to the present invention.
Figure 8:
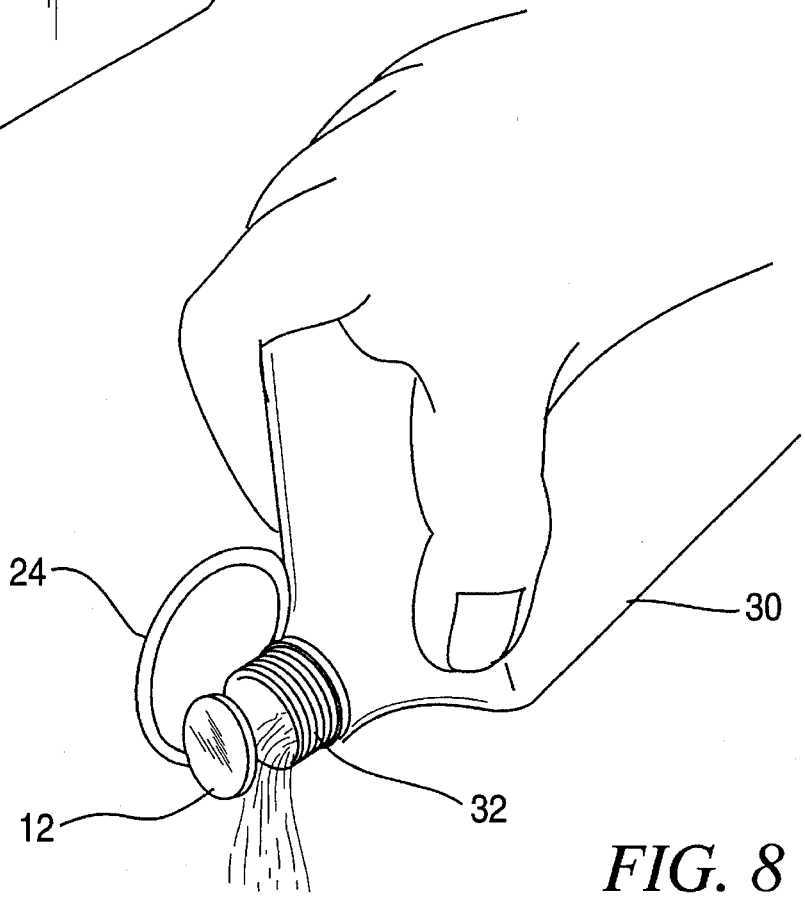
FIG. 8 illustrates a container with the lid, tether, and a threaded cap in place according to the present invention.

As illustrated in FIGS. 7, the hydraulic lid 12 is pressed onto the neck of the container, either by the user or by the manufacturer. If installed by the user and a foil seal is affixed over the mouth of the container, the foil is removed prior to placing the lid on the container opening. The container is then inverted and squeezed as shown by FIG. 8, causing the hydraulic pressure generated by compressing the fluid in the container to force the lid from the mouth of the container and allowing the liquid to pour from the interior of the container.

By attaching the hydraulic lid to the container via an exterior tether, the present invention permits the lid to be removed from the path of the fluid flow after it is expelled from the opening. If a supple material is used for the tether, gravity will cause the lid to hang straight down from the neck of the container while the fluid exits the mouth at a slight angle. If a relatively stiff material is used for the tether, the lid can be forced away from the opening in a desired direction by preforming the shape of the tether. In either case, providing an unobstructed fluid flow advantageously permits the user to guide the liquid into an obstructed receptacle by holding the container above the opening in the receptacle, or holding the container opening into the receptacle opening.

Figure 6:
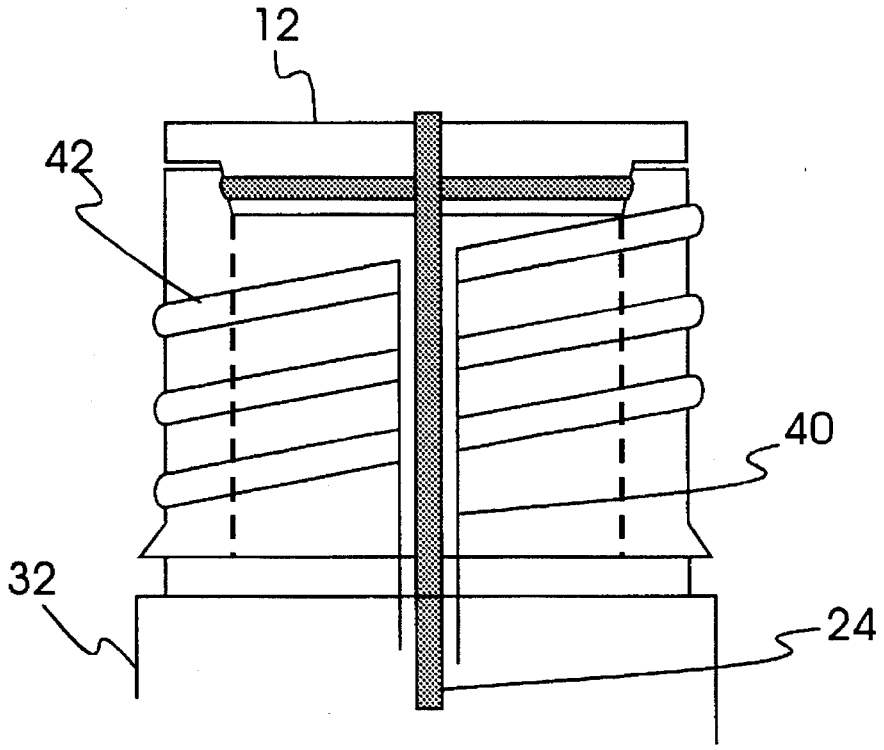
FIG. 6 illustrates an embodiment having a groove formed in the neck of the container for accommodating the tether underneath the threaded cap while the lid is in place.
Figure 9:
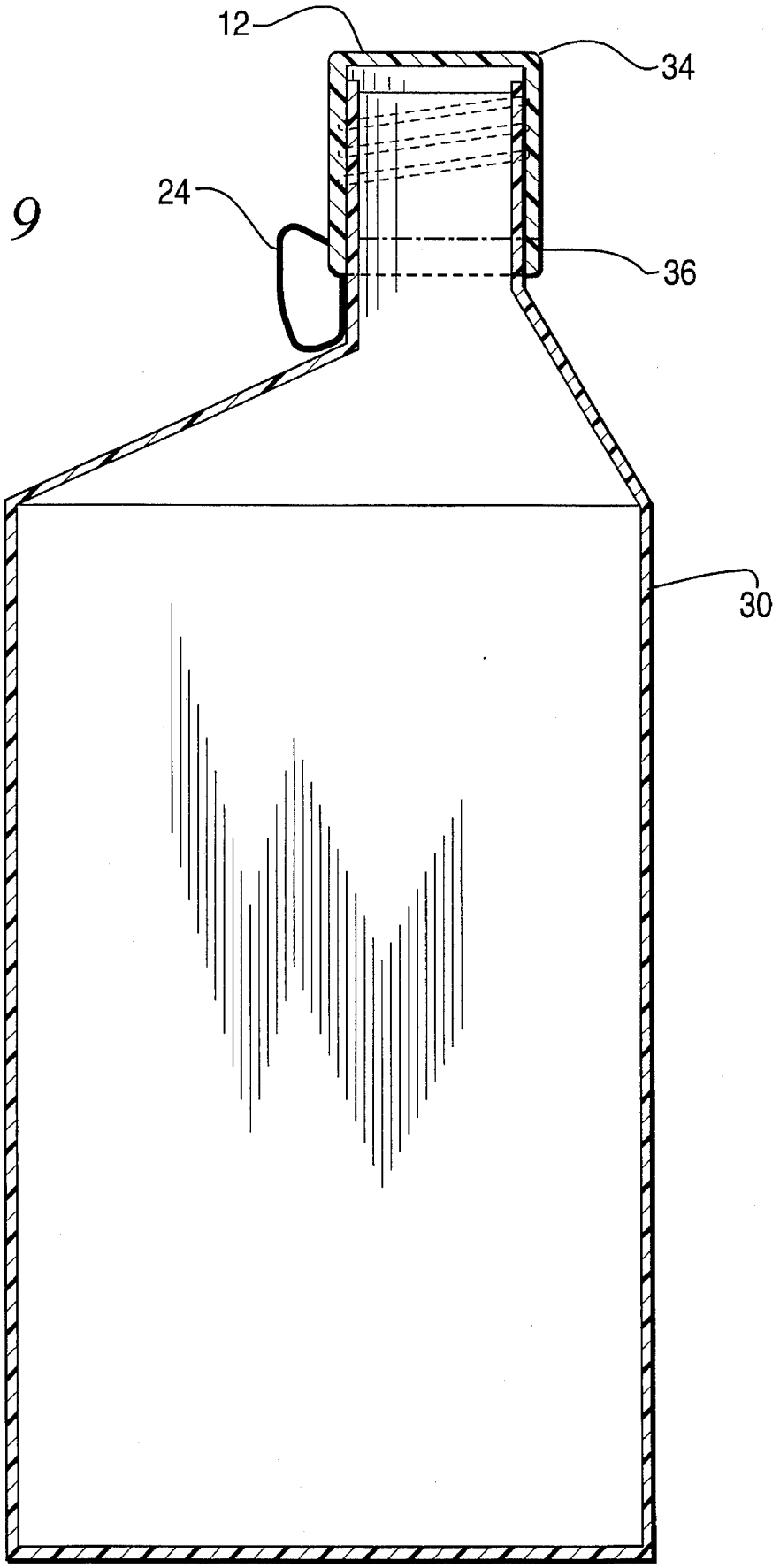
FIG. 9 illustrates the operation of the present invention.

The neck 32 of the container 30 as shown in FIG. 6 has a groove 40 formed into the threads 42 at right angles to the rim of the container, to accommodate the tether 24. If the container is not emptied, the hydraulic lid can be repositioned back onto the container opening and the cap screwed back onto the container, with the tether accommodated in the groove between the cap and the neck of the bottle as is shown in FIG. 9. The lid prevents leakage while the container is stored, and also prevents contamination of the lid after it has been placed in contact with oil; the lid is retained in place by the threaded cap to prevent it from being expelled if the container is accidentally compressed. Furthermore, the hydraulic lid is able to again retain the liquid within the container while it is inverted and squeezed to discharge the remaining liquid. If the lid is used as part of the container seal during the manufacturing process, this prevents the lid from being contaminated by external debris.

It is understood that the foregoing is by way of example, and modifications may be made thereto without departing from the present invention, which is defined by the appended claims.

I claim:

1. A hydraulically expellable lid, comprising:

a beveled plug member having an exterior circumferential surface exhibiting a first diameter substantially equal to an inner diameter of a neck defining an orifice into a flexible container closable by a cap providing engagement with an outer surface of the neck, and tapering to a second diameter less than said first diameter;

an elastically deformable ridge superimposed around and circumscribing a central portion of said plug member between said first and second diameters, releasably engaging the inner surface of the neck when said plug member is forcibly inserted into the neck of the container, said ridge having a diameter greater than said first diameter, and releasably disengaging the inner surface of the neck when the volume of the flexible container is compressed;

an upper lip extending radially outwardly from said first diameter of said plug member to beyond the inner surface of the neck of the container when said plug member is forcibly inserted into the neck of the container, with said lip forming a continuous surface exhibiting a greatest cross-sectional dimension that lies in a plane including the orifice and that accommodates said engagement; and an elongated tether attached at a first end to a surface of said upper lip exterior to said container when said plug member is forcibly inserted into the neck of the container and extending radially outwardly from said upper lip, and attached at a second end to one of the exterior of the container and the cap.

2. The hydraulically expellable lid of claim 1, comprising said tether being molded as part of the neck of the container.

3. The hydraulically expellable lid of claim 1, said tether further comprising:

a loop of elastic material at said second end of said tether having a lesser circumference than an exterior surface of the neck of the container, said loop elastically retaining said tether to the neck.

4. The hydraulically expellable lid of claim 1, comprising said ridge circumscribing a central portion of said plug member being spaced apart from said upper lip.

5. The hydraulically expellable lid of claim 1, said ridge comprising a flexible, compressible material.

6. The hydraulically expellable lid of claim 5, said ridge comprising a rubber O-ring.

7. The lid of claim 1, further comprised of said plug member with said exterior surface continuously tapered absent said ridge, between said first diameter and said second diameter.

8. The lid of claim 1, further comprised of said ridge being integrally formed as a component part of said lid.

9. The lid of claim 7, further comprised of said plug member with said exterior surface continuously tapered absent said ridge, between said first diameter and said second diameter.

10. A spill proof bottle assembly, comprising:

a flexible plastic bottle having an elongated neck portion, said elongated neck portion including a threaded external surface, a smooth inner surface, and a rim forming an outlet of said bottle;

a plug member having an external portion forming a lip covering said rim and an internal portion inserted into said elongated neck portion of said bottle, said internal portion of said plug member having a cross-section conforming to the shape of a cross-section of said internal surface of said elongated neck portion, and tapering from a first circumference at the outlet of said bottle to a second circumference at the portion of said plug member extending furthest into said elongated neck portion, said internal portion of said plug member further comprising a ridge circumscribing and extending outwardly from said internal tapered internal portion, said ridge compressed against said smooth inner surface of said elongated neck portion and frictionally engaging said smooth inner surface while said flexible plastic bottle is in an uncompressed state and releasing said inner surface when said flexible plastic bottle is compressed; and a tether attaching an external portion of said plug member to a point on the exterior of said flexible plastic bottle.

11. A spill proof bottle assembly as recited in claim 10, further comprising:

a cap having a top and a cylindrical side wall, said cylindrical side wall including a threaded internal surface engaging said threaded external surface of said flexible plastic bottle, said cap enclosing said external portion of said plug member; and said elongated neck portion having a groove extending perpendicular to said rim across said threaded external surface, said groove accommodating placement of said tether between said cylindrical side wall and said threaded external surface of said elongated neck.

12. A spill proof bottle assembly as recited in claim 11, wherein:

said cap further comprises a ring formed by perforations circumscribing said cylindrical side wall equidistant from said top and below said threaded internal surface, said ring adapted to remain around said elongated neck while said cap is unscrewed by separating from said cap along said perforations; and said tether is formed to said ring.

13. A spill proof bottle assembly as recited in claim 11, said tether further comprising:

a loop of elastic material having a length less than a circumference of said threaded external surface of said elongated neck portion of said flexible bottle, said loop elastically retaining said tether to said elongated neck portion.

14. A spill proof bottle assembly as recited in claim 10, comprising said bottle and said plug member being formed from identical materials.

15. A spill proof bottle assembly as recited in claim 10, comprising:

said plug member and said ridge having a circular cross-section; and said external portion forming a lip being spaced apart from said ridge circumscribing said internal portion of said plug member.

* * * * *